United States Patent [19]

Ujihara et al.

[11] 4,432,222

[45] Feb. 21, 1984

[54] STRETCH DRAWING APPARATUS

[75] Inventors: Shin Ujihara, Yokohama; Takashi Yoshizawa, Ayase, both of Japan

[73] Assignee: Nissan Motor Company, Limited, Yokohama, Japan

[21] Appl. No.: 343,472

[22] Filed: Jan. 28, 1982

[30] Foreign Application Priority Data

Feb. 13, 1981 [JP] Japan ..... 56-20349

[51] Int. Cl.[3] ..... B21D 22/00

[52] U.S. Cl. ..... 72/350; 72/347; 72/379

[58] Field of Search ..... 72/347, 348, 349, 350, 72/351, 377, 378, 379

[56] References Cited

U.S. PATENT DOCUMENTS

| | | | |
|---|---|---|---|
| 909,342 | 1/1909 | Smith | 72/350 |
| 2,985,128 | 5/1961 | Henrickson | 72/351 |
| 3,550,421 | 12/1970 | Stokel | 72/350 |
| 3,664,172 | 5/1972 | Cvacho | 72/350 |
| 3,668,914 | 6/1972 | Voitsekhovsky | 72/350 |
| 4,195,510 | 4/1980 | Juergens | 72/377 |

FOREIGN PATENT DOCUMENTS

| | | |
|---|---|---|
| 582237 | 11/1946 | United Kingdom . |
| 594128 | 11/1947 | United Kingdom . |
| 959094 | 5/1964 | United Kingdom . |
| 959093 | 5/1964 | United Kingdom . |
| 1010408 | 11/1965 | United Kingdom . |
| 1029755 | 5/1966 | United Kingdom . |

*Primary Examiner*—Leon Gilden

*Attorney, Agent, or Firm*—Lane, Aitken and Kananen

[57] ABSTRACT

A stretch drawing apparatus comprising a constraining die having an inner die portion and an outer wall portion spaced apart from the die portion, a drawing punch positioned in conjunction with the die portion, a blank-holding block positioned in conjunction with the outer wall portion of the constraining die, the constraining die and each of the drawing punch and the blank-holding block being movable relative to each other in a predetermined direction so that the die portion and each of the drawing punch and the blank-holding block are movable toward and away from each other, and at least one wedge member having a blank-holding surface and movable in a direction perpendicular to the predetermined direction, wherein the wedge member engages the constraining die and the blank-holding block and has a thickness which increases away from the die portion toward the outer wall portion of the constraining die.

10 Claims, 8 Drawing Figures

STRETCH DRAWING APPARATUS

FIELD OF THE INVENTION

The present invention relates to a stretch drawing apparatus for drawing a sheet metal blank into a concavely shaped article.

GENERAL BACKGROUND OF THE INVENTION

In drawing a sheet metal blank into a concavely shaped article with use of a combination of a constraining die and a drawing punch driven by a hydraulic ram, it is important to have marginal portions of the blank firmly gripped to prevent the blank from forming wrinkles by the tensile strains applied thereto. A series of beads and corresponding depressions are thus usually formed on the blank-holding surfaces to have the marginal portions of the blank gripped therebetween. Problems have however been encountered in a stretch drawing apparatus using such blank-holding surfaces. The present invention contemplates provision of a useful solution to these problems.

SUMMARY OF THE INVENTION

In accordance with the present invention, there is proposed a stretch drawing apparatus comprising a constraining die having an inner die portion and an outer wall portion spaced apart from the die portion; a drawing punch positioned in conjunction with the die portion; a blank-holding block positioned in conjunction with the outer wall portion of the constraining die; the constraining die and each of the drawing punch and the blank-holding block being movable relative to each other in a predetermined direction so that the die portion and each of the drawing punch and the blank-holding block are movable toward and away from each other; and at least one wedge member having a blank-holding surface and movable in a direction perpendicular to the predetermined direction; the wedge member engaging the constraining die and the blank-holding block in a direction parallel with the predetermined direction and having in the parallel direction a thickness which increases away from the die portion toward the outer wall portion of the constraining die. In one preferred embodiment of the present invention, the wedge member is movable between the die portion and the outer wall portion of the constraining die and on a plane perpendicular to the above mentioned predetermined direction and the blank-holding surface of the wedge member is slanting with respect to the aforesaid plane in a direction to enlarge the thickness of the wedge member away from the die portion of the constraining die, the blank-holding block having a blank-holding surface engageable with and slanting conformingly to the blank-holding surface of the wedge member. In another preferred embodiment of the present invention the above mentioned wedge member is one of first and second wedge members, the first wedge member having the aforesaid blank-holding surface and being movable between the die portion and the outer wall portion of the constraining die and on a plane perpendicular to the above mentioned predetermined direction, the blank-holding surface of the first wedge member slanting with respect to the above mentioned plane in a direction to enlarge the thickness of the wedge member away from the die portion of the constraining die, the second wedge member being positioned between the blank-holding block and the first wedge member and being movable substantially in parallel with the blank-holding surface of the first wedge member and having a blank-holding surface conforming to the blank-holding surface of the first wedge member. In this instance, the stretch drawing apparatus according to the present invention may further comprise a guide member positioned between the blank-holding block and the second wedge member and having a surface slanting in a direction to enlarge the thickness of the guide member in a direction perpendicular to the aforesaid predetermined direction, the second wedge member having another surface slanting conformingly to and slidable on the slanting surface of the guide member. In still another preferred embodiment of the present invention, the above mentioned wedge member is one of first and second wedge members, the first wedge member having the aforesaid blank-holding surface and being movable between the die portion and the outer wall portion of the constraining die, the blank-holding surface of the first wedge member being substantially perpendicular to the above mentioned predetermined direction, the first wedge member having another surface slanting with respect to the blank-holding surface thereof in a direction to enlarge the thickness of the wedge member away from the die portion of the constraining die, the second wedge member being positioned between the blank-holding block and the first wedge member and being movable substantially in parallel with the blank-holding surface of the first wedge member and having a blank-holding surface conforming to the blank-holding surface of the first wedge member. In this instance, the stretch drawing apparatus according to the present invention may further comprise a guide member positioned between the constraining die and the first wedge member and having a surface slanting conformingly to the slanting surface of the first wedge member, and a guide member positioned between the blank-holding block and the second wedge member and having a surface slanting in a direction to enlarge the thickness of the guide member in a direction perpendicular to the aforesaid predetermined direction, the second wedge member having another surface slanting conformingly to and slidable on the slanting surface of the guide member.

BRIEF DESCRIPTION OF THE DRAWINGS

Drawbacks of a prior-art stretch drawing apparatus and further features of a stretch drawing apparatus according to the present invention will be understood from the following description taken in conjunction with the accompanying drawings, in which like reference numerals designate similar or corresponding members, units and portions and in which.

DESCRIPTION OF THE PRIOR ART

Figure 1:
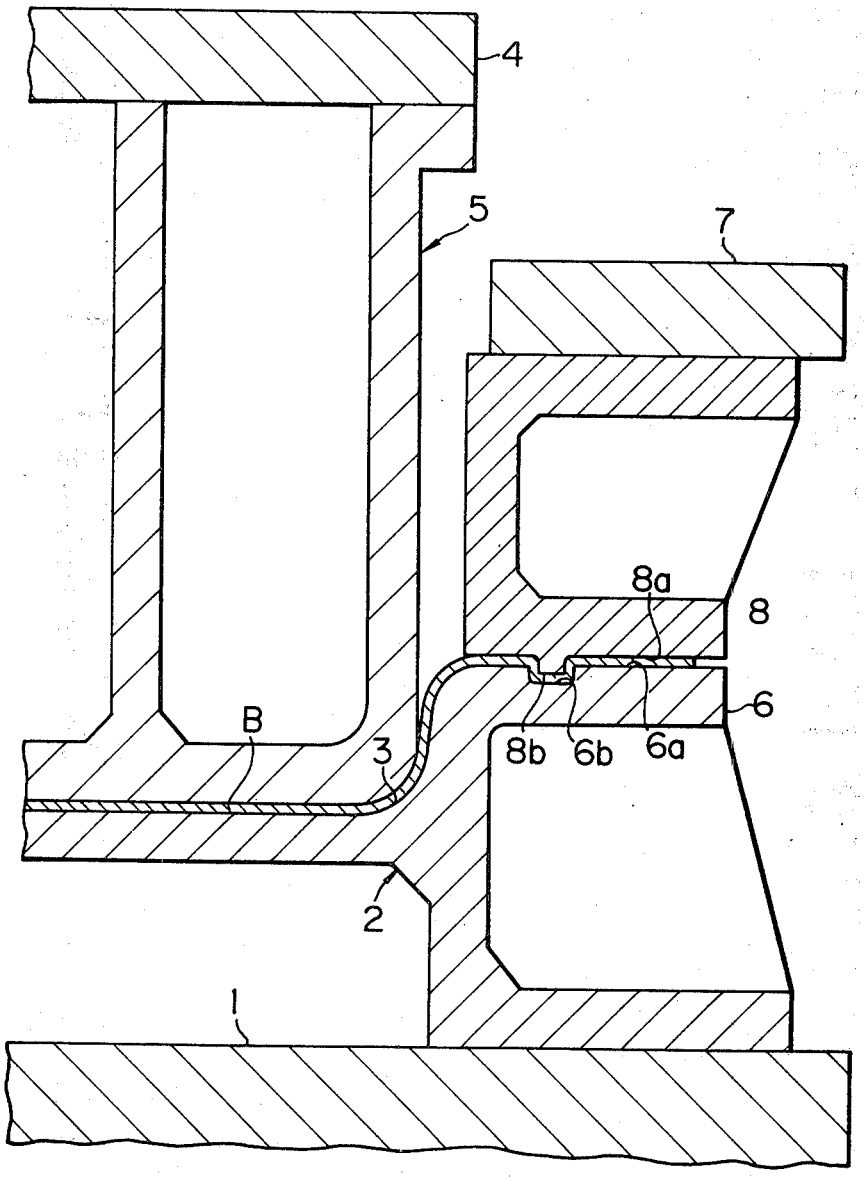
FIG. 1 PRIOR ART
FIG. 1 is a fragmentary vertical sectional view of a prior-art stretch drawing apparatus.

A typical example of a prior-art stretch drawing apparatus of the nature to which the present invention appertains is shown in FIG. 1. The stretch drawing apparatus comprises a stationary base member constituted by a bolster plate 1 having a stationary constraining die 2 fixedly supported thereon. The constraining die 2 is formed with an upwardly open concavity 3 which is shaped conformingly to the desired shape of the article to be drawn from a sheet metal blank B. Above the constraining die 2 is positioned a drawing ram 4 which is movable downwardly and upwardly in a main hydraulic power cylinder (not shown). The drawing ram 4 has a drawing punch 5 having a lower surface portion shaped conformingly to the surface defining the concavity 3 in the constraining die 2. The drawing punch 5 is thus movable toward and away from the concavity 3 in the constraining die 2 as the drawing ram 4 is driven to move downwardly and upwardly, respectively, in the main power cylinder. The constraining die 2 has a raised land portion 6 surrounding or juxtaposing the concavity 3. Above the land portion 6 of the constraining die 2 is positioned a blank-holding ram 7 movable downwardly and upwardly in an auxiliary power cylinder (not shown). The blank-holding ram 7 has a blank-holding punch 8, which is thus movable toward and away from the land portion 6 of the constraining die 2 as the blank-holding ram 7 is driven to move downwardly and upwardly, respectively, in the auxiliary power cylinder. The land portion 6 of the constraining die 2 has a flat upper surface constituting a blank-holding surface 6*a* extending around or along the concavity 3 in the die 2 and is formed with a series of upwardly open depressions 6*b*. On the other hand, the blank-holding punch 8 has a flat lower surface constituting a blank-holding surface 8*a* and is formed with a series of beads 8*a* vertically aligned with the above mentioned depressions 6*b*, respectively.

In operation, the sheet metal blank B is placed on the land portion 6 of the constraining die 2 with a portion thereof located atop of the concavity 3 in the die 2 and with the drawing and blank-holding rams 4 and 7 held in positions above the constraining die 2. The main and auxiliary power cylinders are then actuated to drive the rams 4 and 7 to move downwardly. This causes the drawing punch 5 and the blank-holding punch 8 to move downwardly toward the concavity 3 and land portion 6, respectively, of the constraining die 2 and are brought into pressing contact with the upper face of the sheet metal blank B. Before the drawing punch 5 comes into contact with the sheet metal blank B, the blank-holding punch 8 is brought into pressing contact with the blank B and thereby has the blank B or, more specifically, a marginal portion of the blank B clamped between the blank-holding surface 6*a* of the land portion 6 and the blank-holding surface 8*a* of the blank-holding punch 8. As a consequence, the beads 8*b* of the blank-holding punch 8 force the marginal portion of the blank B to partially crowd into the depressions 6*b* in the land portion 6. The marginal portion of the sheet metal blank B is in this manner forcefully gripped between the blank-holding surfaces 6*a* and 8*a* not only by the pressure exerted between the surfaces 6*a* and 8*a* but effectively by the engagement between the blank-holding punch 8 and the land portion 6 of the constraining die 2 through the beads 8*b* of the former and the depressions 6*b* in the latter. After the sheet metal blank B is thus clamped firmly between the blank-holding surfaces 6*a* and 8*a*, the drawing punch 5 is brought into pressing engagement with the blank B and forces the blank to stretch into the concavity 3 in the constraining die 2 until the blank B is forced against the surface defining the concavity 3. Upon completion of the drawing operation performed as described above, the marginal portion of the blank B now having a series of depressions formed in the marginal portion is cut off from the blank B. An article (not shown) which is concavely shaped conformingly to the concavity 3 in the constraining die 2 is thus obtained.

A drawback of the prior-art stretch drawing apparatus of the nature described above results from the fact that the sheet metal blank B to be processed therein must be prepared to have a fairly large excess portion to provide the marginal portion to be gripped by the depressions 6*b* and beads 8*b*. The excess portion is to be cut off from the shaped blank and discarded as above noted and unduly increases the cost for the material required for the manufacture of the article. Another drawback is that the tensile strains produced in the marginal portion of the blank B in lateral directions of the blank are applied directly to the edges forming the depressions 6*a* in the constraining die 2 and the beads 8*b* of the blank-holding punch 8 and promote early wear of the constraining die 2 and the blank-holding punch 8. An object of the present invention is to provide an improved stretch drawing apparatus free from these drawbacks of a prior-art stretch drawing apparatus of the described nature.

DESCRIPTION OF THE EMBODIMENTS

Figure 2:
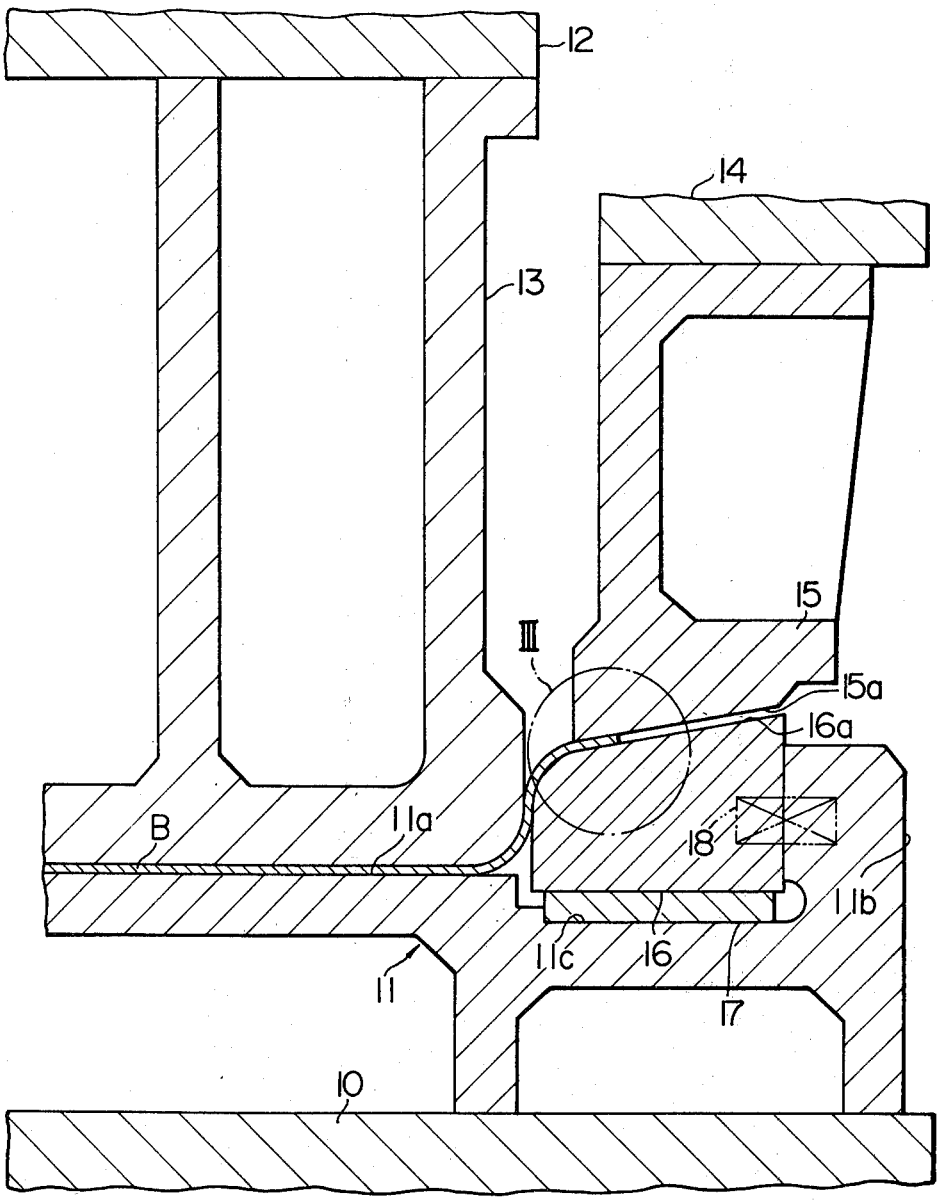
FIG. 2 is a view similar to FIG. 1 but shows a first preferred embodiment of a stretch drawing apparatus according to the present invention.
Figure 3:
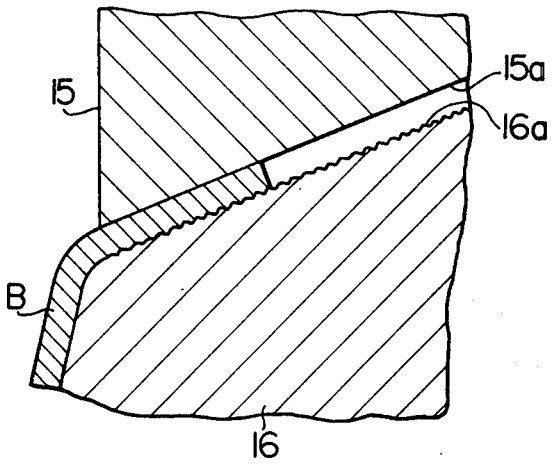
FIG. 3 is a sectional view showing, to an enlarged scale, the region enclosed by a circle III in FIG. 2.

FIGS. 2 and 3 of the drawings show a first preferred embodiment of the stretch drawing apparatus according to the present invention to achieve such an object. Referring first to FIG. 2, the stretch drawing apparatus comprises a stationary base member constituted by a bolster plate 10 having a stationary constraining die 11 fixedly supported thereon. The constraining die 11 has a generally horizontal, laterally inner die portion 11*a* having a horizontal flat upper surface which is shaped conformingly to the desired shape of the article to be drawn from a sheet metal blank B. Above the inner die portion 11*a* of the constraining die 11 is positioned a down-stroke main or drawing ram 12 which is movable downwardly and upwardly in a main hydraulic power cylinder (not shown). The drawing ram 12 has a lower head member constituting a main or drawing punch 13 having a lower surface portion shaped conformingly to the upper surface of the die portion 11*a* of the constraining die 11. The drawing punch 13 is thus movable toward and away from the die portion 11*a* of the constraining die 11 as the drawing ram 12 is driven to move downwardly and upwardly, respectively, in the main power cylinder. The constraining die 11 further has a raised laterally outer wall portion 11*b* surrounding or juxtaposing the inner die portion 11*a*. The outer wall portion 11*b* is laterally spaced apart from the inner die portion 11*a* of the die 11, which is thus formed with a depression 11*c* extending alongside the outer wall portion 11*b* and having a horizontal flat upper surface between the die portion 11*a* and the outer wall portion 11*b*. The outer wall portion 11*b* of the constraining die 11 has a flat vertical inner face confronting the die portion 11*a* and located above the laterally outer end of the depression 11*c*. Above the depression 11*c* of the constraining die 11 is positioned a down-stroke auxiliary or blank-holding ram 14 which is movable downwardly and upwardly in an auxiliary power cylinder (not shown). The blank-holding ram 14 has a lower head member constituting an auxiliary or blank-holding block 15, which is thus movable toward and away from the depression 11*c* of the constraining die 11 as the blank-holding ram 14 is driven to move downwardly and upwardly, respectively, in the auxiliary power cylinder. The blank-holding block 15 has a flat lower surface 15*a* slanting laterally upwardly away from the die portion 11*a* of the constraining die 11 at a predetermined angle with respect to a horizontal plane and constituting a blank-holding surface.

In the stretch drawing apparatus embodying the present invention as shown in FIGS. 2 and 3, there is further provided a wedge member 16 positioned on the depression 11*c* of the constraining die 11 through a guide plate 17 having a horizontal flat upper face. The wedge member 16 has a flat upper surface 16*a* slanting laterally upwardly away from the die portion 11*a* of the constraining die 11 conformingly to the blank-holding surface 15*a* constituted by the lower surface of the blank-holding block 15, the slanting upper surface 16*a* of the wedge member 16 constituting a blank-holding surface. At least one of the blank-holding surface 15*a* and blank-holding surface 16*a* , such as the blank-holding surface 16*a* of the wedge member 16 is roughened as partially shown to an enlarged scale in FIG. 3. The wedge member 16 thus shaped is slidable on the guide plate 17 laterally toward and away from the inner die portion 11*a* of the constraining die 11 and assumes a laterally outermost lateral position remotest from the die portion 11*a* when held in contact with the vertical inner face of the outer wall portion 11*b* of the constraining die 11. The wedge member 16 is urged to move away from such an outermost position, viz., toward the die portion 11*a* of the constraining die 11 by suitable biasing means such as a preloaded helical compression spring 18. The spring 18 is received in part in a recess formed in the outer wall portion 11*b* and in part in the wedge member 16 as indicated by dot-and-dash lines in FIG. 2. Though not shown in the drawings, a blank holding arrangement essentially similar to the above described blank holding arrangement including the outer wall portion 11*b* and depression 11*c* of the constraining die 11, the blank-holding ram 14, the blank-holding block 15, the wedge member 16, and the guide plate 17 is provided on the opposite side of the stretch drawing apparatus across the inner die portion 11*a* of the constraining die 11.

In operation, the sheet metal blank B to be drawn into a concavely shaped article is placed on the blank-holding surface 16*a* of the wedge member 16 and that of the wedge member (not shown) located opposite to the wedge member 16 across the die portion 11*a* of the constraining die 11. Thus, the blank B has opposite marginal portions respectively received on the upper blank-holding surface 16*a* of the wedge member 16 and the upper blank-holding surface of the wedge member of the other blank holding arrangement with a remaining middle portion of the blank B located atop of the inner die portion 11*a* of the constraining die 11. At this stage of the drawing operation, the drawing and blank-holding rams 12 and 14 are held in raised positions above the constraining die 11. The main and auxiliary power cylinders associated with the drawing and blank-holding rams 12 and 14, respectively, are then actuated to drive the rams 12 and 14 to move downwardly. This causes the drawing punch 13 and the blank-holding block 15 to move downwardly toward the die portion 11*a* and depression 11*c*, respectively, of the constraining die 11 and to be brought into downwardly pressing contact with the upper face of the sheet metal blank B. Before the drawing punch 13 is permitted to reach the upper face of the blank B, the blank-holding block 15 and its counterpart on the opposite side of the constraining die 11 are brought into pressing contact with the blank B and thereby have the blank B or, more specifically, the opposite marginal portions of the blank B clamped respectively between the blank-holding surface 15*a* of the blank-holding block 15 and the blank-holding surface 16*a* of the wedge member 16 and between those of the other blank holding arrangement of the apparatus. The force applied downwardly from the blank-holding block 15 to the marginal portion of the blank B and through the blank B to the wedge member 16 causes the wedge member 16 to slide on the guide plate 17 laterally away from the die portion 11*a* of the constraining die 11 against the force of the spring 18 until the wedge member 16 is brought into contact with the vertical inner face of the outer wall portion 11*b* of the die 11. In this instance, the sheet metal blank B, or more specifically, a middle portion of the blank B is pulled in opposite directions by the two wedge members thus moved away from each other and is, as a consequence, slightly stretched and drawn on a horizontal plane above the die portion 11*a* of the constraining die 11. After the sheet metal blank B is thus clamped firmly between the blank-holding surfaces 15*a* and 16*a*, the drawing punch 13 is brought into downwardly pressing engagement with the blank B and forces the blank B to stretch above the die portion 11*a* of the constraining die 11 until the blank B is forced against the upper surface of the die portion 11*a*. When the blank B is being thus drawn between the drawing punch 13 and the die portion 11*a* of the constraining die 11, the marginal portion of the blank B clamped between the blank-holding surfaces 15*a* and 16*a* is pulled toward the die portion 11*a* of the constraining die 11 and thus urges the wedge member 16 to move away from the outer wall portion 11*b* of the constraining die 11. It therefore follows that the wedge member 16 presses the marginal portion of the blank B upwardly against the blank-holding surface 15*a* of the blank-holding block 15. Thus, the larger the pull applied to the marginal portion of the blank B, the greater the pressure by which the marginal portion of the blank B is gripped between the blank-holding surfaces 15*a* and 16*a*, due to the outwardly increasing height of the wedge member 16. Upon completion of the drawing operation performed as described above, the main and auxiliary power cylinders for the drawing and blank-holding rams 12 and 14 are actuated to move the rams 12 and 14 and accordingly the drawing and blank-holding punches 13 and 15 upwardly to their respective initial positions above the constraining die 11. A concavely shaped article is now obtained on the constraining die 11.

Figure 4:
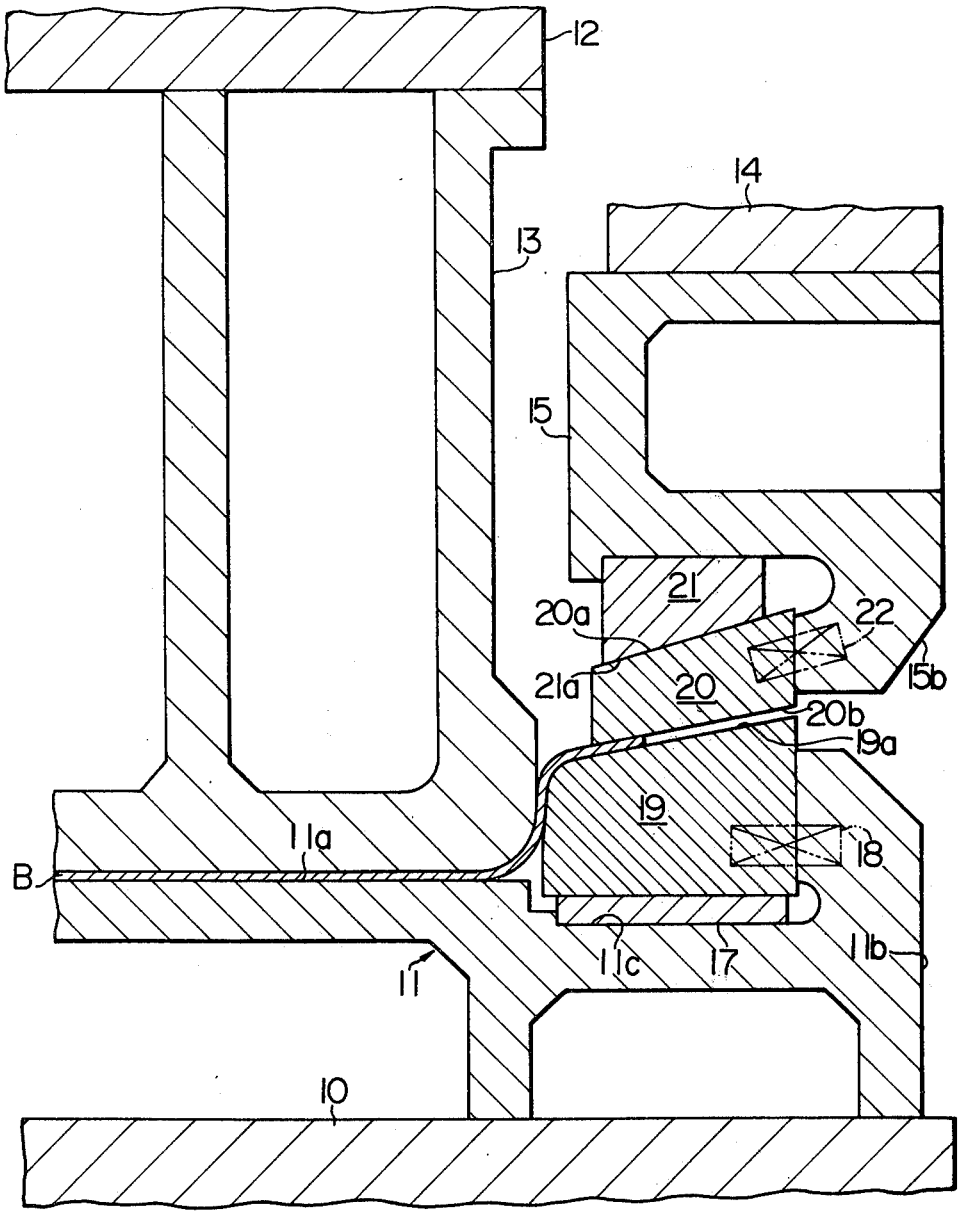
FIG. 4 is a view also similar to FIG. 1 but shows a second preferred embodiment of a stretch drawing apparatus according to the present invention.

FIG. 4 of the drawings shows a second preferred embodiment of the stretch drawing apparatus according to the present invention. The stretch drawing apparatus shown in FIG. 4 is a modification of the embodiment hereinbefore described with reference to FIGS. 2 and 3 and, thus, comprises a bolster plate 10 fixedly carrying thereon a stationary constraining die 11 having a laterally inner die portion 11*a*, a raised, laterally outer wall portion 11*b* and a depression 11*c*. Above the inner die portion 11*a* of the constraining die 11 is positioned a drawing ram 12 which is thus movable downwardly and upwardly in a main hydraulic power cylinder (not shown). The drawing ram 12 has a lower head member constituting a main or drawing punch 13 movable toward and away from the die portion 11*a* of the constraining die 11 as the drawing ram 12 is driven to move downwardly and upwardly, respectively, in the main power cylinder. Above the depression 11*c* of the constraining die 11 is positioned a blank-holding ram 14 which is movable downwardly and upwardly in an auxiliary power cylinder (not shown). The blank-holding ram 14 has a lower head member constituting a blank-holding block 15, which is thus movable toward and away from the depression 11*c* of the constraining die 11 as the blank-holding ram 14 is driven to move downwardly and upwardly, respectively, in the auxiliary power cylinder. The blank-holding punch 15 has a horizontal flat lower surface above the depression 11*c* of the constraining die 11. The blank-holding block 15 of the stretch drawing apparatus shown in FIG. 4 further has a downwardly projecting, laterally outer wall portion 15*b* having a flat vertical inner face which is vertically aligned with the flat inner face of the outer wall portion 11*b* of the constraining die 11.

In the stretch drawing apparatus embodying the present invention as shown in FIG. 4, there are further provided lower and upper wedge members 19 and 20. The lower wedge member 19 is shaped and arranged similarly to the wedge member 16 of the embodiment of FIGS. 2 and 3 and is thus positioned on the depression 11*c* of the constraining die 11 through a lower guide plate 17 having a horizontal flat upper face. The lower wedge member 19 has a flat upper surface 19*a* slanting laterally upwardly away from the die portion 11*a* of the constraining die 11 at a predetermined angle with respect to a horizontal plane, the slanting upper surface of the lower wedge member 19 constituting a blank-holding surface. The lower wedge member 19 is slidable on the horizontal upper surface of the lower guide plate 17 laterally toward and away from the inner die portion 11*a* of the constraining die 11 and assumes a laterally outermost lateral position remotest from the die portion 11*a* when held in contact with the vertical inner face of the outer wall portion 11*b* of the constraining die 11. The lower wedge member 19 is urged to move away from such an outermost position, viz., toward the die portion 11*a* of the constraining die 11 by suitable biasing means such as a preloaded helical compression spring 18. On the other hand, the upper wedge member 20 is supported by the blank-holding block 15 and is positioned below the above mentioned horizontal lower surface of the blank-holding block 15 with an upper guide plate 21 provided therebetween. The upper guide plate 21 has a lower surface 21*a* slanting upwardly away from above the die portion 11*a* of the constraining die 11 at a predetermined angle with respect to a horizontal plane. The upper wedge member 20 has upper and lower surfaces 20*a* and 20*b* also slanting upwardly away from above the die portion 11*a* of the constraining die 11 at predetermined angles with respect to a horizontal plane. The lower slanting surface 20*b* of the upper wedge member 20 constitutes a blank-holding surface and is slanting conformingly to the blank-holding surface 19*a* of the lower wedge member 19. On the other hand, the upper slanting surface 20*a* of the upper wedge member 20 is held in slidable contact with the lower slanting surface 21*a* of the upper guide plate 21. The upper wedge member 20 is thus slidable on the lower slanting surface 21*a* of the guide plate 21 laterally toward and away from the inner die portion 11*a* of the constraining die 11 and assumes a laterally outermost lateral position remotest from the die portion 11*a* when held in contact with the vertical inner face of the outer wall portion 15*b* of the blank-holding block 15. The upper wedge member 20 is urged to move away from such an outermost position, viz., toward the die portion 11*a* of the constraining die 11 by suitable biasing means such as a preloaded helical compression spring 22. At least one of the blank-holding surface 19*a* and blank-holding surface 20*b*, such as the blank-holding surface 19*a* of the lower wedge member 19 is preferably roughened, through not shown as such in FIG. 4.

In operation, the sheet metal blank B to be drawn into a concavely shaped article is placed on the blank-holding surface 19*a* of the lower wedge member 19 and that of the lower wedge member (not shown) located opposite to the lower wedge member 19 across the die portion 11*a* of the constraining die 11. When the main and auxiliary power cylinders associated with the drawing and blank-holding rams 12 and 14, respectively, are actuated to drive the rams 12 and 14 to move downwardly, the drawing and blank-holding blocks 13 and 15 are driven to move downwardly and are brought into pressing contact with the upper face of the sheet metal blank B. Before the drawing punch 13 is permitted to reach the blank B, the blank-holding block 15 and its counterpart on the opposite side of the constraining die 11 are moved toward the constraining die 11 until the opposite marginal portions of the blank B are clamped respectively between the blank-holding surface 19*a* of the lower wedge member 19 and the blank-holding surface 20*b* of the upper wedge member 20 and between those of the other blank holding arrangement of the apparatus. A downward force is thus applied from the blank-holding block 15 to the upper guide plate 21 and further to the upper wedge member 20 and through the guide plate 21 and the wedge member 20 to the marginal portion of the blank B. The downward force is further applied through the marginal portion of the blank B to the lower wedge member 19. By the force applied from the upper guide plate 21 to the upper wedge member 20, the wedge member 20 is caused to slide on the lower slanting surface 21*a* of the guide plate 21 laterally away from above the die portion 11*a* of the constraining die 11 against the force of the spring 22 until the upper wedge member 20 is brought into contact with the vertical inner face of the outer wall portion 15*b* of the blank-holding block 15. On the other hand, the force applied from the upper wedge member 20 to the lower wedge member 19 through the marginal portion of the blank B causes the lower wedge member 19 to slide on the horizontal upper surface of the lower guide plate 17 laterally away from the die portion 11*a* of the constraining die 11 against the force of the spring 18 until the lower wedge member 19 is brought into contact with the vertical inner face of the outer wall portion 11*b* of the constraining die 11. In this instance, the sheet metal blank B, or more specifically, a middle portion of the blank B is pulled in opposite directions by the wedge members 19 and 20 thus moved away from the die portion 11*a* and their respective counterparts provided on the opposite side of the constraining die 11. The middle portion of the blank B is therefore slightly stretched and drawn on a horizontal plane above the die portion 11*a* of the constraining die 11. After the sheet metal blank B is thus clamped firmly between the blank-holding surfaces 19*a* and 20*b*, the drawing punch 13 is brought into downwardly pressing engagement with the blank B and forces the blank B to stretch above the die portion 11*a* of the constraining die 11 until the blank B is forced against the upper surface of the die portion 11*a*. When the blank B is being thus drawn between the drawing punch 13 and the die portion 11*a* of the constraining die 11, the marginal portion of the blank B clamped between the blank-holding surfaces 19*a* and 20*b* is pulled toward the die portion 11*a* of the constraining die 11 and thus urges the lower wedge member 19 to move away from the outer wall portion 11*b* of the constraining die 11. It therefore follows that the lower wedge member 19 more forcefully presses the marginal portion of the blank B upwardly against the blank-holding surface 20*b* of the upper wedge member 20 so that the marginal portion of the blank B is gripped forcefully between the blank-holding surfaces 19*a* and 20*b* with the greater pressure.

FIGS. 5 to 8 of the drawings shows a third preferred embodiment of the stretch drawing apparatus according to the present invention. The stretch drawing apparatus shown in FIGS. 5 to 8 is a further modification of the embodiment hereinbefore described with reference to FIG. 4 and, thus, comprises a bolster plate 10, a stationary constraining die 11, a drawing ram 12, a drawing punch 13, a blank-holding ram 14, and a blank-holding block 15. The constraining die 11 has a laterally inner die portion 11*a*, a laterally outer wall portion 11*b* and a depression 11*c*. Similarly to its counterpart in the embodiment of FIG. 4, the blank-holding block 15 has a horizontal flat lower surface above the depression 11*c* of the constraining die 11 and a downwardly projecting, laterally outer wall portion 15*b* having a flat vertical inner face vertically aligned with the flat inner face of the outer wall portion 11*b* of the constraining die 11 as shown.

Figure 5:
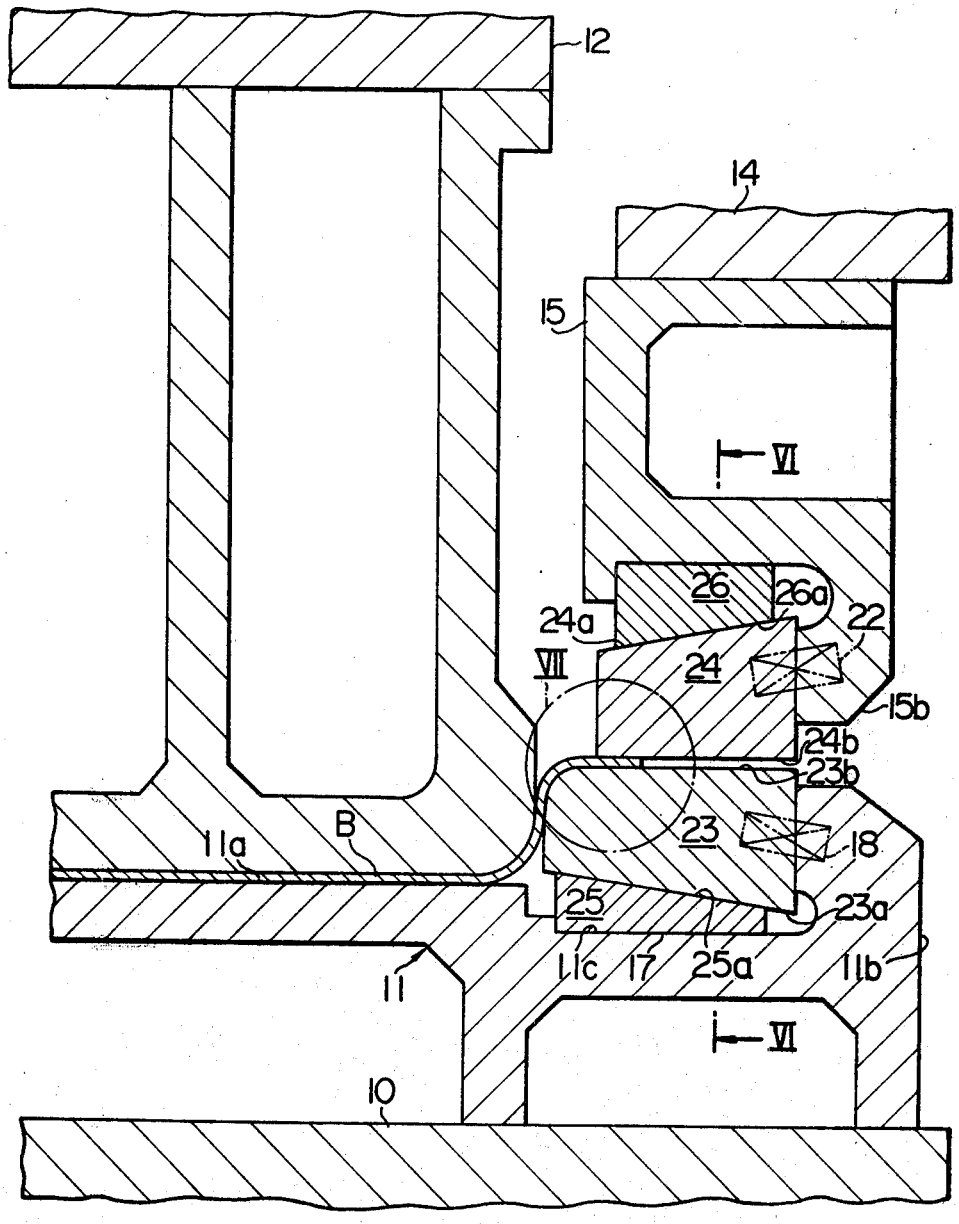
FIG. 5 is a view also similar to FIG. 1 but shows a third preferred embodiment of a stretch drawing apparatus according to the present invention.
Figure 6:
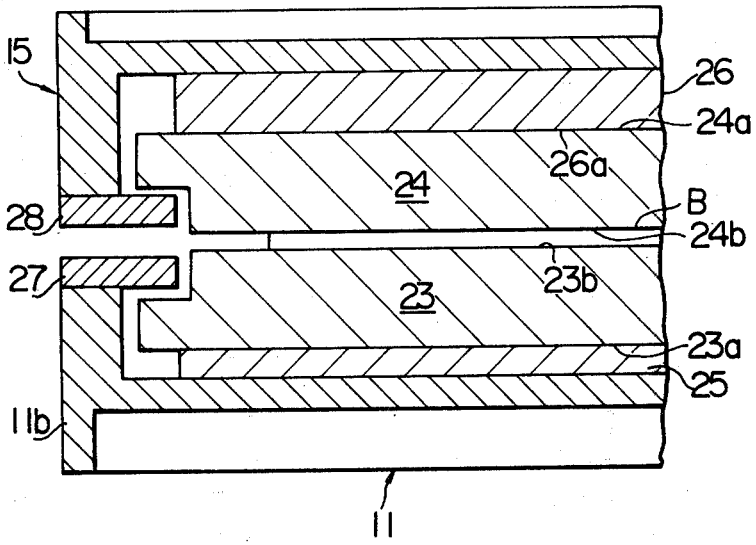
FIG. 6 is a section taken along line VI—VI in FIG. 5.
Figure 7:
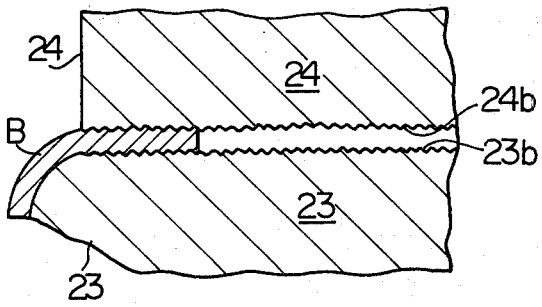
FIG. 7 is a sectional view showing, to an enlarged scale, the region enclosed by a circle VII in FIG. 5.
Figure 8:
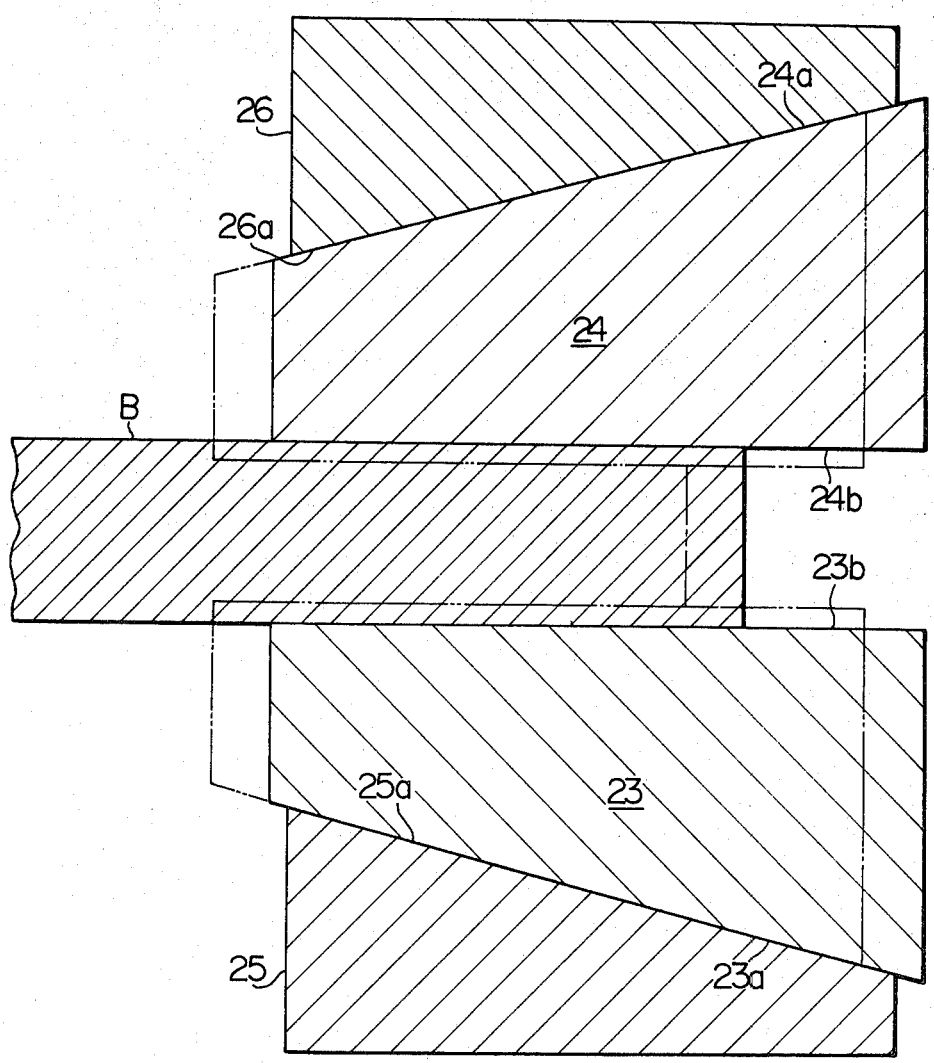
FIG. 8 is a fragmentary vertical sectional view showing, also to an enlarged scale, portions of the apparatus illustrated in FIG. 5.

In the stretch drawing apparatus embodying the present invention as shown in FIGS. 5 to 8, there are further provided lower and upper wedge members 23 and 24 supported in the constraining die 11 and blank-holding block 15, respectively, as will be seen from FIGS. 5 and 6. The lower wedge member 23 is positioned on the depression 11*c* of the constraining die 11 through a lower guide plate 25 having a flat upper face 25*a* slanting downwardly away from the die portion 11*a* of the constraining die 11 at a predetermined angle with respect to a horizontal plane. The lower wedge member 23 has a flat lower surface 23*a* slanting laterally downwardly away from the die portion 11*a* of the constraining die 11 conformingly to the slanting upper surface of the lower guide plate 25, and a horizontal flat upper surface 23*b* constituting a blank-holding surface. The lower wedge member 23 is slidable on the slanting upper surface 25*a* of the guide plate 25 laterally toward and away from the inner die portion 11*a* of the constraining die 11 and assumes a laterally outermost lateral position remotest from the die portion 11*a* when held in contact with the vertical inner face of the outer wall portion 11*b*. The lower wedge member 23 is urged to move away from such an outermost position, viz., toward the die portion 11*a* of the constraining die 11 by suitable biasing means such as a preloaded helical compression spring 18. On the other hand, the upper wedge member 24 is supported by the blank-holding block 15 and is positioned below the above mentioned horizontal lower surface of the blank-holding block 15 with an upper guide plate 26 provided therebetween. The upper guide plate 26 has a lower surface 26*a* slanting upwardly away from above the die portion 11*a* of the constraining die 11 at a predetermined angle with respect to a horizontal plane. The upper wedge member 24 has a flat upper surface 24*a* slanting upwardly away from above the die portion 11*a* of the constraining die 11 conformingly to the slanting lower surface 26*a* of the upper guide plate 26, and a horizontal flat lower surface 24*b* constituting a blank-holding surface. The upper slanting surface 24*a* of the upper wedge member 24 is held in slidable contact with the lower slanting surface 26*a* of the upper guide plate 26. The upper wedge member 24 is thus slidable on the lower slanting surface 26*a* of the guide plate 26 laterally toward and away from above the inner die portion 11*a* of the constraining die 11 and assumes a laterally outermost lateral position remotest from the die portion 11*a* when held in contact with the vertical inner face of the outer wall portion 15*b* of the blank-holding block 15. The upper wedge member 24 is urged to move away from such an outermost position, viz., toward the die portion 11*a* of the constraining die 11 by suitable biasing means such as a preloaded helical compression spring 22. At least one of the blank-holding surface 23*b* and blank-holding surface 24*b* is preferably roughened. In the embodiment herein shown, it is assumed, by way of example, that both of the blank-holding surface 23*b* and blank-holding surface 24*b* of the wedge members 23 and 24 are roughened as illustrated in FIG. 7. The lower wedge member 23 and the lower guide plate 25 are retained in the constraining die 11 by retaining members one of which is shown at 27 in FIG. 6 and, likewise, the upper wedge member 24 and the upper guide plate 26 are retained in the blank-holding block 15 by retaining members one of which is shown at 28 in FIG. 6.

In operation, the sheet metal blank B to be drawn into a concavely shaped article is placed on the horizontal blank-holding surface 23*a* of the lower wedge member 23 and that of the lower wedge member (not shown) located opposite to the lower wedge member 23 across the die portion 11*a* of the constraining die 11. When the drawing and blank-holding blocks 13 and 15 are driven to move downwardly, the blank-holding block 15 and its counterpart on the opposite side of the constraining die 11 are moved toward the constraining die 11 until the opposite marginal portions of the blank B are clamped respectively between the blank-holding surface 23*b* of the lower wedge member 23 and the blank-holding surface 24*b* of the upper wedge member 24 and between those of the other blank holding arrangement of the apparatus. A downward force is thus applied from the blank-holding block 15 to the upper guide plate 26 and further to the upper wedge member 24 and through the guide plate 26 and the wedge member 24 to the marginal portion of the blank B. The downward force is further applied through the marginal portion of the blank B to the lower wedge member 23. By the force applied from the upper guide plate 26 to the upper wedge member 24, the wedge member 24 is caused to slide on the lower slanting surface 26*a* of the guide plate 26 laterally away from the die portion 11*a* of the constraining die 11 against the force of the spring 22 until the upper wedge member 24 is brought into contact with the vertical inner face of the outer wall portion 15*b* of the blank-holding block 15. On the other hand, the force applied from the upper wedge member 24 to the lower wedge member 23 through the marginal portion of the blank B causes the lower wedge member 23 to slide on the slanting upper surface 25*a* of the lower guide plate 25 laterally away from the die portion 11*a* of the constraining die 11 against the force of the spring 18 until the lower wedge member 23 is brought into contact with the vertical inner face of the outer wall portion 11*b* of the constraining die 11. After the sheet metal blank B is thus clamped firmly between the blank-holding surfaces 23*b* and 24*b*, the drawing punch 13 is brought into downwardly pressing engagement with the blank B and forces the blank B to stretch above the die portion 11*a* of the constraining die 11 until the blank B is forced against the upper surface of the die portion 11*a*. When the blank B is being thus drawn between the drawing punch 13 and the die portion 11*a* of the constraining die 11, the marginal portion of the blank B clamped between the blank-holding surfaces 23*b* and 24*b* is pulled toward the die portion 11*a* of the constraining die 11. The wedge members 23 and 24 having the marginal portion of the blank B between their respective roughened blank-holding surfaces 23*b* and 24*b* are slightly moved away from the outer wall portion 11*b* of the constraining die 11 toward the die portion 11*a* from the positions indicated by solid lines to the positions indicated by dot-and-dash lines in FIG. 8. The lower wedge member 23 is thus enabled to more forcefully presses the marginal portion of the blank B upwardly against the blank-holding surface 24*b* of the upper wedge member 24 so that the marginal portion of the blank B is gripped forcefully between the blank-holding surfaces 23*b* and 24*b* with the greater pressure.

What is claimed is:

1. A stretch drawing apparatus comprising a constraining die having an inner die portion and an outer wall portion spaced apart from the die portion;

a drawing punch positioned in conjunction with said die portion;

a blank-holding block positioned in conjunction with said outer wall portion of the constraining die;

the constraining die and each of said drawing punch and said blank-holding block being movable relative to each other in a predetermined direction so that said die portion and each of the drawing punch and the blank-holding block are movable toward and away from each other; and at least one wedge member having a blank-holding surface and movable in a direction perpendicular to said predetermined direction;

said wedge member engaging said constraining die and said blank-holding block in a direction parallel with said predetermined direction and having in the parallel direction a thickness which increases away from the die portion toward the outer wall portion of the constraining die.

2. A stretch drawing apparatus as set forth in claim 1, in which said wedge member is movable between said die portion and said outer wall portion of the constraining die and on a plane perpendicular to said predetermined direction and in which the blank-holding surface of said wedge member is slanting with respect to said plane in a direction to enlarge said thickness of the wedge member away from the die portion of said constraining die, said blank-holding block having a blank-holding surface engageable with and slanting conformingly to the blank-holding surface of said wedge member.

3. A stretch drawing apparatus as set forth in claim 2, in which the blank-holding surface of at least one of said wedge member and said blank-holding block is roughened.

4. A stretch drawing apparatus as set forth in claim 2 or 3, further comprising biasing means urging said wedge member toward the die portion of said constraining die.

5. A stretch drawing apparatus as set forth in claim 1, in which said wedge member is one of first and second wedge members, the first wedge member having said blank-holding surface and being movable between said die portion and said outer wall portion of the constraining die and on a plane perpendicular to said predetermined direction, the blank-holding surface of the first wedge member slanting with respect to said plane in a direction to enlarge said thickness of the wedge member away from the die portion of said constraining die, the second wedge member being positioned between said blank-holding block and said first wedge member and being movable substantially in parallel with the blank-holding surface of said first wedge member and having a blank-holding surface conforming to the blank-holding surface of the first wedge member.

6. A stretch drawing apparatus as set forth in claim 5, further comprising a guide member positioned between said blank-holding block and said second wedge member and having a surface slanting in a direction to enlarge the thickness of the guide member in a direction perpendicular to said predetermined direction, said second wedge member having another surface slanting conformingly to and slidable on the slanting surface of said guide member.

7. A stretch drawing apparatus as set forth in claim 1, in which said wedge member is one of first and second wedge members, the first wedge member having said blank-holding surface and being movable between said die portion and said outer wall portion of the constraining die, the blank-holding surface of the first wedge member being substantially perpendicular to said predetermined direction, the first wedge member having another surface slanting with respect to said blank-holding surface thereof in a direction to enlarge said thickness of the wedge member away from the die portion of said constraining die, the second wedge member being positioned between said blank-holding block and said first wedge member and being movable substantially in parallel with the blank-holding surface of said first wedge member and having a blank-holding surface conforming to the blank-holding surface of the first wedge member.

8. A stretch drawing apparatus as set forth in claim 7, further comprising a guide member positioned between said constraining die and said first wedge member and having a surface slanting conformingly to the slanting surface of the first wedge member, and a guide member positioned between said blank-holding block and said second wedge member and having a surface slanting in a direction to enlarge the thickness of the guide member in a direction perpendicular to said predetermined direction, said second wedge member having another surface slanting conformingly to and slidable on the slanting surface of said guide member.

9. A stretch drawing apparatus as set forth in any one of claims 5 to 8, in which the blank-holding surface of at least one of said first and second wedge members is roughened.

10. A stretch drawing apparatus as set forth in any one of claims 5 to 8, further comprising biasing means urging each of said first and second wedge members toward the die portion of said constraining die.

* * * * *